US010240720B2

(12) United States Patent
Cola et al.

(10) Patent No.: US 10,240,720 B2
(45) Date of Patent: Mar. 26, 2019

(54) PRESSURE VALVE

(71) Applicant: Faber Industrie S.p.A., Cividale del Friuli, Udine (IT)

(72) Inventors: Gian Luigi Cola, Cividale del Friuli (IT); Raffaele Di Sarno, Cividale del Friuli (IT)

(73) Assignee: Faber Industrie S.p.A., Cividale del Friuli (IT)

( * ) Notice: Subject to any disclaimer, the term of this patent is extended or adjusted under 35 U.S.C. 154(b) by 15 days.

(21) Appl. No.: 15/326,110

(22) PCT Filed: Jun. 16, 2015

(86) PCT No.: PCT/IB2015/054540
§ 371 (c)(1),
(2) Date: Jan. 13, 2017

(87) PCT Pub. No.: WO2016/009288
PCT Pub. Date: Jan. 21, 2016

(65) Prior Publication Data

US 2017/0211747 A1 Jul. 27, 2017

(30) Foreign Application Priority Data

Jul. 17, 2014 (IT) ..... MI2014A1311

(51) Int. Cl.
*F17C 1/06* (2006.01)
*F17C 1/16* (2006.01)

(52) U.S. Cl.
CPC ..... *F17C 1/06* (2013.01); *F17C 1/16* (2013.01); *F17C 2201/0109* (2013.01); *F17C 2201/056* (2013.01); *F17C 2203/0604* (2013.01); *F17C 2203/066* (2013.01); *F17C 2203/0607* (2013.01); *F17C 2203/0619* (2013.01); *F17C 2203/0621* (2013.01); *F17C 2203/0663* (2013.01); *F17C 2205/0305* (2013.01); *F17C 2205/051* (2013.01); *F17C 2223/0123* (2013.01); *F17C 2223/035* (2013.01);
(Continued)

(58) Field of Classification Search
CPC ..... F17C 1/06; F17C 2203/0604; F17C 2203/0607; F17C 2203/0619; F17C 2203/066; F17C 2203/0663; F17C 2205/0305; F17C 2223/0123; F17C 60/012
USPC ..... 220/590
See application file for complete search history.

(56) References Cited

U.S. PATENT DOCUMENTS 3,843,010 A * 10/1974 Morse ..... F17C 1/06 138/30
4,854,988 A * 8/1989 Voirol ..... B29C 53/602 156/155
5,429,845 A * 7/1995 Newhouse ..... F17C 1/16 138/30

FOREIGN PATENT DOCUMENTS

WO WO 2011/152732 A1 12/2011
WO WO 2014/014049 A1 1/2014

* cited by examiner

*Primary Examiner* — King M Chu
(74) *Attorney, Agent, or Firm* — Blank Rome LLP

(57) ABSTRACT

Pressure vessel (1) with a gas-impermeable liner (2) and a reinforcing layer (4) in composite material formed externally around the impermeable liner (2), as well as at least one boss (5) coupled to the impermeable liner (2) and to the reinforcing layer (4), wherein between the impermeable liner (2) and the boss (5) a polymeric sealing mass (7) is
(Continued)

arranged bound to both the impermeable liner (2) and to the boss (5) by means of in situ cross-linking of the sealing mass (7).

16 Claims, 3 Drawing Sheets

(52) U.S. Cl.
CPC .. *F17C 2223/036* (2013.01); *F17C 2260/012* (2013.01); *F17C 2270/01* (2013.01)

PRESSURE VALVE

The present invention relates to pressure vessels and, more particularly, to new systems and methods for pressure vessels in composite material surrounded by a reinforcing layer.

The development of advanced composite materials has enabled the creation of lightweight pressure vessels in wrapped composite material ("composite overwrap material") classified into different categories, such as the type 4 indicating pressure vessels with a non-metallic inner lining ("liner") and a composite reinforcement outer layer.

One of the critical aspects of making a type 4 pressure vessel is the interface between the non-metal inner liner and the metal "boss" which houses the valve and/or forms the connection of the pressure vessel with an external duct of fluid.

The interface between the non-metallic liner, typically plastic, and the metal boss must ensure an impermeable seal able to withstand cyclical pressurisation and depressurisation for the entire lifetime of the pressure vessel.

To this end it is known of to make the inner liner in plastic with a collar that projects in the axial direction of the boss and extends inside the boss up to an internal threading for the screwing of the valve. The valve is provided with circumferential grooves which house sealing O-rings which, with the valve screwed into the boss, engage the collar of plastic liner and stress it radially outwards against the inner surface of the boss. This way an impermeable seal is achieved in the valve-O-ring-inner collar interface of the liner (FIGS. 1*a-d*)

In a second prior solution, the plastic inner lining is not in direct contact with the boss but with an additional insert in thermoplastic material which extends inside the boss as far as the vicinity of the threading for screwing the valve. The valve is provided with circumferential grooves which house sealing O-rings which, with the valve screwed into the boss, engage the insert in thermoplastic material and stress it radially outwards against the inner surface of the boss. This way an impermeable seal is achieved in the valve-O-ring-insert and insert-internal liner interfaces (FIGS. 2*a-d*).

Both prior solutions present a risk of permeability and of leakage along the O-rings, which increases with time and which is due to the "creep" phenomenon (a gradual plastic deformation depending on time and on the condition of permanent stress) of the inner liner collar and of the insert of thermoplastic material in the areas of contact with the seals, as shown in FIGS. 1*d* and 2*d*.

The purpose of the present invention is therefore to improve the coupling between the non-metal inner lining and the metal boss of type 4 pressure vessels so as to ensure permanent gas-impermeability.

These and other purposes are achieved by means of a pressure vessel with a gas impermeable liner and a reinforcing layer in composite material formed externally around the impermeable liner, as well as a boss coupled to the impermeable liner and to the reinforcing layer to form an opening of the vessel connectable to an external duct, wherein between the impermeable liner and the boss a polymeric sealing mass is arranged which is bound to both the impermeable liner and to the boss by means of in situ cross-linking of the sealing mass.

The cross-linked polymer sealing mass creates a stable, impermeable and permanent bond with the non-metallic impermeable liner and with the metal boss.

According to one aspect of the invention, the cross-linked sealing mass is an elastomer able to adapt to and to compensate possible deformations of the impermeable liner.

In addition, one or more O-rings placed between the boss and a valve screwed into the boss are in direct contact with a metal sealing surface of the boss.

This way it is possible to simply and efficiently obviate the risk of slipping ("creep") phenomena of the surfaces engaged by the seals and to achieve levels of reliability of type 1 pressure vessels (steel).

For a clearer understanding of the invention and its advantages some of its embodiments, made by way of non-limiting examples will be described below with reference to the drawings, wherein:

FIGS. 1*a, b, c* and *d* illustrate the creep phenomenon in a coupling between the impermeable liner and the boss in a gas cylinder of the prior art;

FIGS. 2*a, b, c* and *d* illustrate the creep phenomenon in a further prior solution of coupling between the impermeable liner and the boss in a gas cylinder;

Figure 1A:
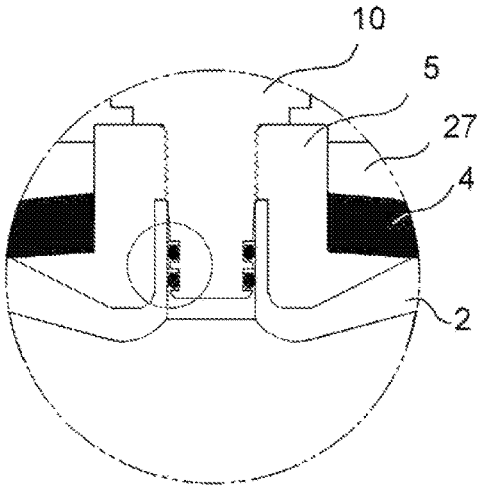
Figure 2A:
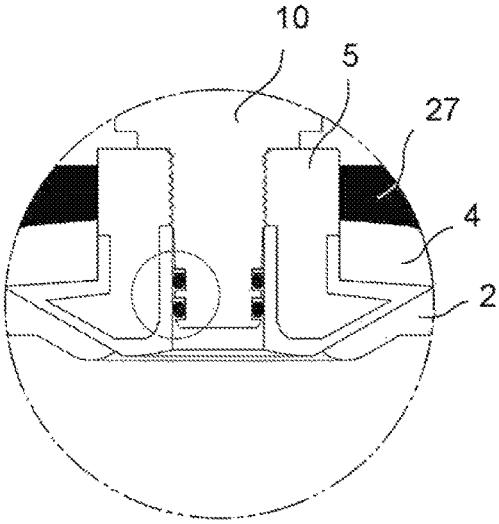
Figure 1B:
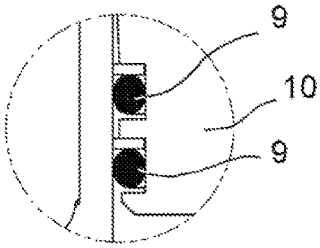
Figure 2B:
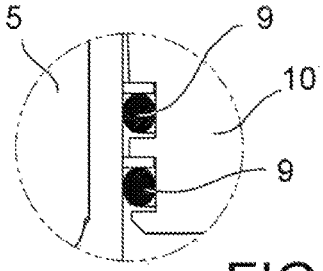
Figure 1C:
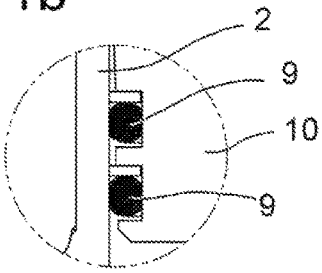
Figure 2C:
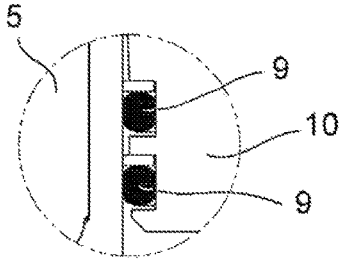
Figure 1D:
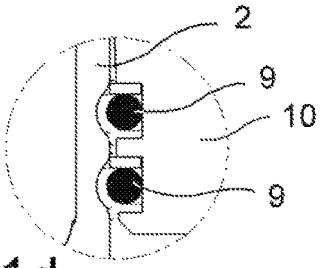
Figure 2D:
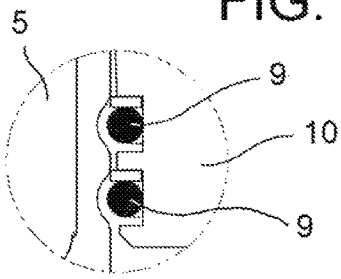

With reference to FIGS. 3 to 7, a pressure vessel 1 has a gas-impermeable liner 2 (usually the innermost layer of the wall 3 of the vessel 1) and a reinforcing layer 4 in composite material formed externally around the impermeable liner 2, as well as at least one boss 5 coupled to the impermeable liner 2 and to the reinforcing layer 4 to obtain an opening 6 of the pressure vessel 1, connectable to an external duct (not shown), wherein between the impermeable liner 2 and the boss 5 a polymeric sealing mass 7 is arranged which is bound to both the impermeable liner 2 and to the boss 5 by means of in situ cross-linking of the sealing mass 7.

The cross-linked polymer sealing mass 7 creates a stable and permanent impermeable bond with the non-metal impermeable liner 2 and with the metal boss 5.

In one embodiment, the sealing mass 7 is an elastomer suitable to adapt to and compensate, within certain limits, possible deformations of the impermeable liner 2.

In addition, the impermeable liner 2 and the sealing mass 7 are spaced by a valve sealing interface 8 between one or more O-rings 9 of a valve 10 screwed into the boss 5, and the boss 5 itself, so that one or more sealing rings 9 of the valve 10 are in direct contact with a metal sealing surface 11 of the boss 5.

This way it is possible to simply and efficiently obviate the risk of slipping ("creep") phenomena of the surfaces engaged by the seals 9 and achieve levels of reliability of type 1 pressure vessels (steel).

In one embodiment, the adhesion of the polymer sealing mass cross-linked in situ 7 is further improved by the presence of a first auxiliary adhesive 13 in an interface 12 between the impermeable liner 2 and the sealing mass 7. One example of an auxiliary adhesive 13 is resorcinol formaldehyde latex (RFL) which in the example of a polyamide impermeable liner 2 (PA6 or PA66) creates a strong chemical bond with the amide.

Similarly a second auxiliary adhesive 14 may be provided for in an interface 14 between the sealing mass 7 and the boss 5.

In one embodiment, the entire sealing mass 7 consists of a mixture of resorcinol formaldehyde latex-based precursors (RFL) so that the cross-linking process in situ makes the elastomer (latex) permanently adhere to the metal boss and fixes the chemical bonds with the impermeable liner 2 in a stable and irreversible manner.

Figure 3:
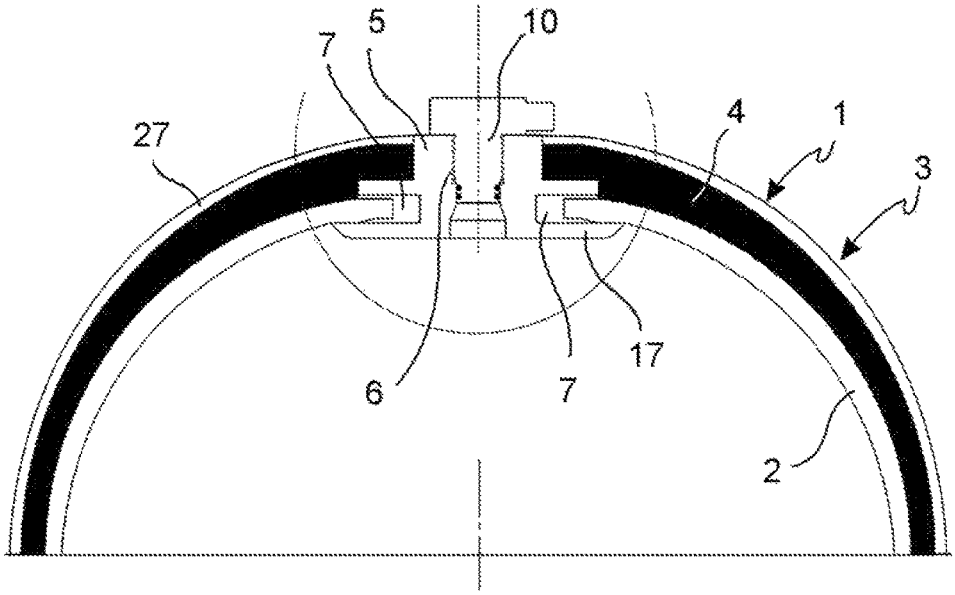
FIG. 3 is a cross-section view of a detail of a pressure vessel according to the invention.
Figure 4:
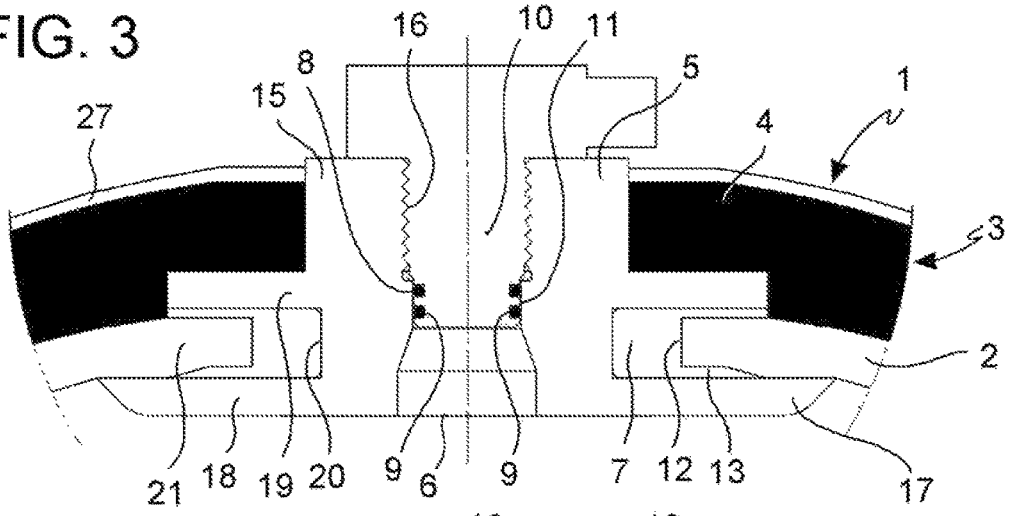
FIG. 4 is a magnified view of a coupling area boss-impermeable liner of the vessel in FIG. 3.
Figure 5:
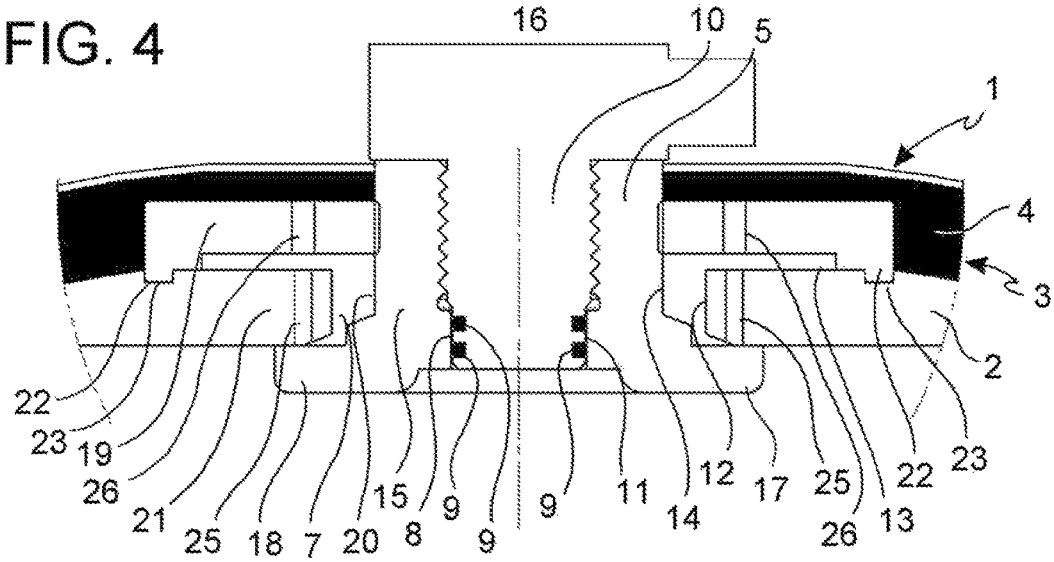
FIG. 5 is a magnified view of a coupling area boss-impermeable liner of the pressure vessel according to a further embodiment.

In one embodiment, the boss 5 comprises a central tubular portion 15 which forms a passage for the pressurised fluid through the opening 6 of the vessel and forms a threaded seat 16 for screwing the valve 10 to the aforesaid metal sealing surface 11 (internal surface of the tubular portion 15) preferably smooth and cylindrical or smooth and frustoconical, against which one or more sealing rings 9 of the valve 10 abut. A coupling flange 17 projects from the tubular portion 15, for example in the shape of a single or double annular disc, forming a seat for the connection of the boss 5 to the impermeable liner 2 (FIGS. 3, 4). The boss 5 composed of the tubular portion 15 and the coupling flange 17 may be made in one piece (FIG. 4), for example, by chip removal machining, forging, moulding or a combination of these machining and forming operations, or in several initially separate pieces subsequently assembled together (FIG. 5).

In one embodiment, the coupling flange 17 forms two (not necessarily circular), preferably substantially parallel, annular discs 18, 19, which form between them an annular slot or groove 20 open radially towards the outside of the boss 5. The annular slot 20 receives a corresponding free edge 21 or collar of the impermeable liner 2 by the interposition of the sealing mass 7. In its final configuration, after the in-situ cross-linking, the sealing mass 7 can form a ring housed in the annular slot 20 of the coupling flange 17 and having in transversal cross-section (radial in relation to the boss) a U-shape which embraces the free edge 21 of the impermeable liner 2. Both the collar 21 of the impermeable liner 2 and the sealing mass 7 are arranged inside the annular slot 20 of the coupling flange.

In one embodiment (FIG. 5) an inner annular disc 18 of the coupling flange 17 is formed in one piece with the tubular portion 15, and an outer annular disc 19 can be screwed on an outer thread of the tubular portion 15 with a possibility of adjusting the axial distance between the two annular discs 18, 19. This facilitates the assembly of the impermeable liner 2 and the boss 5 before the formation of the sealing mass 7 and allows an adaptation of the boss 5 to impermeable liners 2 having different thicknesses.

Figure 6:
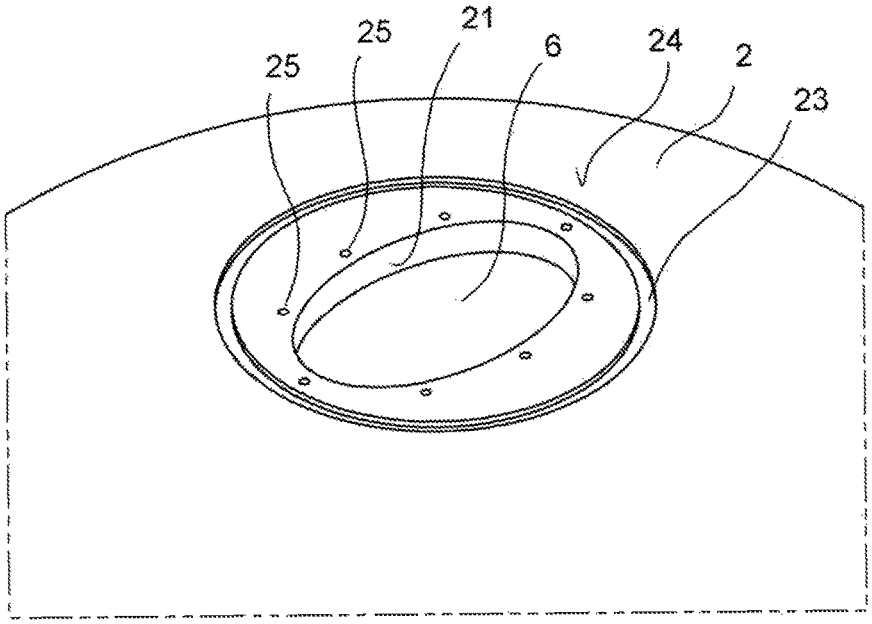
FIG. 6 is a magnified view of a detail of the impermeable liner at the boss of a pressure vessel according to one embodiment.
Figure 7:
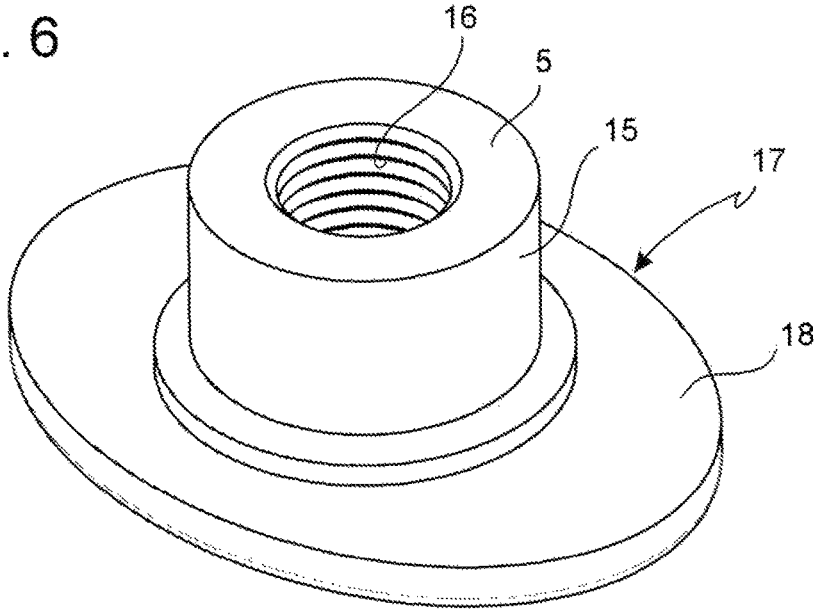
FIG. 7 is a perspective view of a portion of a boss of a pressure vessel according to one embodiment.

The inner annular disc 18 and the free edge 21 of the impermeable liner 2 may have an elliptical or generally elongated and complementary shape, to allow the insertion of the boss 5 in the opening 6 of the impermeable liner 2 and its shape-locking by rotation for example of 90° (FIGS. 6, 7).

To provide a reliable and repeatable positioning reference, the outer annular disc 19 of the coupling flange 17 may have at least one positioning protrusion 22, for example circular and concentric with the longitudinal axis of the tubular portion 15, suitable to be inserted in a corresponding positioning recess 23, for example a circular groove, made in an outer surface 24 of the impermeable liner 2 (FIGS. 5, 7).

In one embodiment, the collar or free edge 21 of the impermeable liner 2 has one or more recesses or through holes 25 in the contact zone with the sealing mass 7, so that the penetration of the sealing mass 7 in the recesses and/or in the through holes 25 and the subsequent cross-linking of the sealing mass 7 form an additional structural coupling between the elastomeric sealing mass 7 and the impermeable liner 2 (FIGS. 5, 6).

The boss 5, in particular the outer annular disc 19, of the coupling flange 17 may form one or more injection holes 26 extending from the outside of the boss 5 up to the space intended to be filled by the sealing mass 7. Said injection holes 26 facilitate the insertion of the not yet cross-linked precursor of the sealing mass 7 and form an additional mechanical coupling after the in situ cross-linking of the sealing mass 7.

The sealing mass 7 is preferably a rubber, for example a silicone or latex rubber or other elastomer which is injectable or spreadable in the form of a single component precursor or mixture of multicomponent precursors, and cross-linkable (vulcanisable) for example by a heat treatment (heating).

Both the sealing mass 7 and the auxiliary adhesive 13 may comprise:

- latex containing at least one resorcinol-formaldehyde resin and chlorosulfonated polyethylene, or
- latex comprising a resorcinol-formaldehyde resin with or without vinylpiridine and/or hydrogenated acrylonitrile butadiene rubber (HNBR), or
- latex comprising at least one resorcinol-formaldehyde-vinylpiridine resin and a acrylonitrile-butadiene rubber (NBR), or
- latex comprising at least one resorcinol-formaldehyde resin and a chlorosulfonated polyethylene resin.

The impermeable liner 2 in synthetic material may for example be made of polyamide (PA6 or PA66), polyethylene (PE), high-density polyethylene (HDPE), polypropylene (PP), acrylonitrile butadiene styrene (ABS), or similar.

The impermeable liner 2 may be attached to the reinforcing layer 4 by means of:

- blow moulding into a mould composed of the reinforcing layer 4 with one or more possible intermediate layers and/or
- moulding of the impermeable liner 2 (for example, using a mould that is different from the reinforcing layer 4) and subsequent wrapping of the reinforcing layer 4 around the impermeable liner 2.

The reinforcing layer 4 has the function of resisting the internal pressure exerted by the stored fluid and may be manufactured by winding filaments of continuous carbon fibres impregnated with epoxy resin on the impermeable liner or layer 2 previously made, or on a mandrel which is subsequently removed.

The reinforcing fibres of the reinforcing layer 4 have a tensile strength of over 4500 MPa, preferably from 4800 MPa to 5200 MPa and a modulus of elasticity of over 200 GPa, preferably from 200 to 250 GPa.

Advantageously, the reinforcing layer 4 comprises a (volumetric) content of reinforcing fibres in the range from 50% vol to 70% vol, preferably from 55% vol to 65% vol, more preferably around 60% vol, where the rest of the volume is composed of the matrix which may be an epoxy resin or vinylester made to harden by heat treatment, e.g. heating to about 120° for about five hours.

Around the reinforcing layer 4 a further outer protection layer 27 may be made, for example a layer of paint or a shock-proof layer.

The boss 5 is made of metallic material, e.g. steel.

In order to improve the adherence of the sealing mass 7 to the impermeable liner 2 it may be opportune to treat the impermeable liner 2 before applying the sealing mass 7 using a plasma surface activation process.

To such purpose, a plasma is generated, i.e. a superionised gas or electrically neutral medium composed of positive and negative particles and neutrals (atoms, molecules and radicals), capable of reacting even with only lightly polarized plastic materials with a very low surface energy. The term "ionised" refers to the presence of free electrons which are not bound to an atom or molecule. The plasma is created by subjecting a gas to a high energy discharge. The gas decomposes into electrons, ions, highly reactive free radicals, shortwave UV light photons and other energised particles. The free radicals and other particles in the highly active plasma can bind to the surface of the impermeable liner 2 of plastic material, resulting in the formation of additional polar groups that have improved chemical attraction for the elastomeric sealing mass 7.

The metal surface of the boss 5 can be treated, before application of the sealing mass 7, by sanding or pickling and/or by applying a layer of adhesion primer.

After the mechanical assembly of the boss 5 with the impermeable liner 2, the precursor of the sealing mass 7 is spread or injected into the coupling area between the boss 5 and the impermeable liner 2, for example via injection holes 26 made in the coupling flange 17 of the boss 5.

After the injection of the precursor of the sealing mass 7, it is subjected to a cross-linking process, for example by heating. This can be done by heating the metal parts of the boss 5, for example, by using electrical resistors or electrical induction.

The pressure vessel 1 thus manufactured and configured can be used for example as a gas cylinder or as a pressure accumulator.

Obviously, a person skilled in the art may make further modifications and variations to the pressure vessel 1 and to the manufacturing method according to the present invention so as to satisfy contingent and specific requirements while remaining within the sphere of protection of the invention as defined by the following claims.

The invention claimed is:

1. A pressure vessel with a gas-impermeable liner and a reinforcing layer in composite material formed externally around the impermeable liner, as well as at least one boss coupled to the impermeable liner and to the reinforcing layer to obtain an opening of the pressure vessel, wherein a polymeric sealing mass is arranged between the impermeable liner and the boss, said polymeric sealing mass being bonded to both the impermeable liner and the boss by in situ cross-linking of the sealing mass.

2. The pressure vessel according to claim 1, wherein the impermeable liner is non-metallic, the boss is metallic and the sealing mass is an elastomeric rubber.

3. The pressure vessel according to claim 1, wherein the impermeable liner and the sealing mass are spaced apart from a valve sealing interface between at least one O-ring gasket of a valve screwed in the boss and the boss itself, said O-ring gasket being in direct contact with a metal sealing surface of the boss.

4. The pressure vessel according to claim 1, comprising a first auxiliary adhesive in an interface between the impermeable liner and the sealing mass.

5. The pressure vessel according to claim 1, comprising a second auxiliary adhesive in an interface between the sealing mass and the boss.

6. The pressure vessel according to claim 1, wherein:

the boss comprises a tubular central portion with a threaded seat for screwing a valve, and a coupling flange projecting from the tubular portion and forming two annular discs which define therebetween an annular slot which is open radially outwardly with respect to a longitudinal axis of the boss, the annular slot receives a corresponding free edge of the impermeable liner by the interposition of the sealing mass, the sealing mass forms a ring received in the annular slot and having in cross-section a U shape enclosing the free edge of the impermeable liner, both the free edge of the impermeable liner and the sealing mass are arranged inside the annular slot.

7. The pressure vessel according to claim 6, wherein an inner annular disc of the coupling flange is formed as a single piece with the tubular portion, and an outer annular disc can be screwed on an outer thread of the tubular portion with a possibility of adjusting the axial distance between the two annular discs.

8. The pressure vessel according to claim 7, wherein the inner annular disc and the free edge of the opening of the impermeable liner have an elliptic or generally elongated and complementary shape, so as to allow the insertion of the boss into the opening of the impermeable liner and blocking of the boss by rotation with respect to the impermeable liner.

9. The pressure vessel according to claim 7, wherein the outer annular disc of the coupling flange forms at least one positioning protrusion, which is preferably circular and concentric with the longitudinal axis of the tubular portion, which inserts in a corresponding positioning recess, preferably a circular groove, formed in an outer surface of the impermeable liner.

10. The pressure vessel according to claim 1, wherein the impermeable liner has one or more through holes in the contact area with the sealing mass, and sections of the sealing mass extending into the through holes make an additional structural coupling between the sealing mass and the impermeable liner.

11. The pressure vessel according to claim 1, wherein the boss forms one or more injection holes extending from the outside of the boss up to the space occupied by the sealing mass.

12. The pressure vessel according to claim 1, wherein:

A) the sealing mass is selected from the group consisting of rubber, silicone rubber, latex, elastomer, injectable or spreadable in the form of monocomponent precursor or mixture of multicomponent precursors and cross-linkable by a thermal treatment, and B) the impermeable liner is made of a synthetic material chosen from the group consisting in polyamide, polyethylene, high-density polyethylene, polypropylene, acrylonitrile butadiene styrene, and the reinforcing layer comprises a wrapping of filament of continuous carbon or glass fibers, impregnated with an epoxy resin, and the boss is made of steel.

13. The pressure vessel according to claim 1, wherein the sealing mass or the auxiliary adhesive are selected from the group consisting in:

latex containing at least one resorcinol-formaldehyde resin and chlorosulfonated polyethylene, latex comprising a resorcinol-formaldehyde resin with or without vinylpiridine and/or hydrogenated acrylonitrile butadiene rubber (HNBR), latex comprising at least one resorcinol-formaldehyde-vinylpiridine resin and a acrylonitrile-butadiene rubber (NBR), latex comprising at least one resorcinol-formaldehyde resin and a chlorosulfonated polyethylene resin.

14. A method for manufacturing a pressure vessel according to claim 1, comprising:

manufacturing the impermeable liner and manufacturing the boss, assembling the boss with the impermeable liner, arranging a hollow space in a coupling region between the boss and the impermeable liner, spreading or injecting a precursor of the sealing mass in the hollow space provided, and subsequently, subjecting the precursor of the sealing mass to a cross-linking process to bind the sealing mass to both the boss and the impermeable liner.

15. The method according to claim 14, wherein the cross-linking process comprises heating metal parts of the boss.

16. The method according to claim 14, comprising treating the impermeable liner before applying the sealing mass by a plasma surface activation process.

* * * * *